US008192231B2

(12) United States Patent
De Blieck et al.

(10) Patent No.: US 8,192,231 B2
(45) Date of Patent: Jun. 5, 2012

(54) SHIELDED CONNECTOR

(75) Inventors: Roland Tristan De Blieck, Et Oss (NL); Michel Fonteneau, Le Mans (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/998,453

(22) PCT Filed: Oct. 22, 2008

(86) PCT No.: PCT/IB2008/055366

§ 371 (c)(1),
(2), (4) Date: Jun. 28, 2011

(87) PCT Pub. No.: WO2010/046735

PCT Pub. Date: Apr. 29, 2010

(65) Prior Publication Data

US 2011/0250790 A1 Oct. 13, 2011

(51) Int. Cl.
*H01R 13/648* (2006.01)

(52) U.S. Cl. ..... 439/607.04

(58) Field of Classification Search ..... 439/607.04, 439/607.05, 607.06, 607.13, 607.17, 607.19, 439/607.37, 607.4, 607.47, 676
See application file for complete search history.

(56) References Cited

U.S. PATENT DOCUMENTS

| | | | | |
|---|---|---|---|---|
| 7,114,981 | B1 | 10/2006 | Huang et al. | 439/353 |
| 7,402,084 | B2 * | 7/2008 | Wu | 439/660 |
| 2004/0157491 | A1 | 8/2004 | Lin | 439/607 |
| 2004/0242070 | A1 | 12/2004 | Inoue et al. | 439/607 |
| 2007/0167078 | A1 | 7/2007 | Yamaji | 439/607 |
| 2008/0171468 | A1 * | 7/2008 | Briant et al. | 439/607 |
| 2008/0188129 | A1 * | 8/2008 | Moritake et al. | 439/609 |
| 2011/0250792 | A1 * | 10/2011 | Whiteman et al. | 439/607.19 |

* cited by examiner

*Primary Examiner* — Tulsidas C Patel
*Assistant Examiner* — Phuongchi Nguyen
(74) *Attorney, Agent, or Firm* — Harrington & Smith

(57) ABSTRACT

The present invention provides a shielding assembly for a connector assembly including a connector and a counterpart connector. The shielding assembly includes a shield member having a shield wall and at least one spring element for making electrical contact between the shield wall and the counterpart connector along a first electrical conduction path in the mated situation of the connector and the counterpart connector. The spring element includes a first portion being configured for making electrical contact with the counterpart connector and a second portion for providing a spring force to the first portion. The spring element is configured for having at least a first position in the unmated situation of the connector and the counterpart connector and a second position in the mated situation of the connector and the counterpart connector, such that in the first position the second portion is arranged at a first separation from the shield wall and in the second position the second portion is arranged at a second separation from the shield wall, wherein the second separation is larger than the first separation.

14 Claims, 9 Drawing Sheets

SHIELDED CONNECTOR

FIELD OF THE INVENTION

The present invention relates generally to structures for preventing or shielding electromagnetic interference ("EMI") emissions from connector assemblies. In particular, the invention relates to shielded electrical connectors and shielding assemblies for connectors for high-speed signal transfer.

BACKGROUND OF THE INVENTION

Connector assemblies may be used in or between electronic devices for transmitting signals between two cables or between a cable and the printed circuit board of an electronic device. It is common practice to make such interconnections with connector assemblies comprising one connector configured to fit at least partially with another connector, or counterpart connector.

It is well known that signals to be transmitted by such connector assemblies may cause EMI emissions. This is particularly the case for high speed and/or frequency signals, such as about 1 gigabit per second and higher, and the effect tends to get worse for increasing signal frequencies. Such EMI radiations may cause electromagnetic disturbance to other neighbouring connector assemblies and/or electrical or electronic devices. Vice versa, electromagnetic radiations emitted by the connector environment may disturb signals transmitted by connectors.

Effective EMI shielding of a connector assembly is usually achieved in electrically connecting conductive shielding arrangements on both connecting parts of the connector assembly with at most small holes, smaller than the shortest wavelength from which shielding is desired. Thus, for effective shielding of a connector assembly at high frequencies one should provide such a connector assembly with at most very small holes in and between the connecting parts.

Resilient gaskets and/or contact springs are used for providing such an electrical connection between the conductive shielding arrangements.

Contact springs provide a certain tolerance for true positioning of the connector and the counterpart connector to be mated, in particular for board-to-board connector assemblies.

SUMMARY

In an aspect of the invention, a shielding assembly according to claim 1 is provided. In the first position (when the connector is not mated with the counterpart connector), the second portion is arranged at a first separation (distance) from the shield wall and in the second position (when the connector is mated with the counterpart connector), the second portion is arranged at a second separation (distance) from the shield wall, wherein the second separation is larger than the first separation. In other words, the second portion or the spring element is moved away from the shield wall when the connector and its counterpart are mated. Of course, since the spring element may be linked at one side to the shielding assembly, the second portion and the shield wall be spread out only on one side (the opposite side to the one linked or attached to the shielding assembly).

According to the invention, the spring elements comprise a first portion for making an electrical contact with the shielding arrangement of the counterpart and a second portion which is at least partially located outside the gap between the connector and its counterpart (or the shielding arrangement of the counterpart). Consequently, in the mated situation the spring elements of the shielding assembly provide electrical contact between the shield member of the assembly and the counterpart connector, preferably with a shielding arrangement of the counterpart connector. The spring elements may comprise a conductive portion or be conductive as a whole, e.g. by being metallic. Such electric contact provides an EMI shielding effect to the connector assembly. In the shielding assembly according to the invention, the second portion is arranged further away from the shield wall in the mated situation than in the unmated situation. This prevents the spring element from becoming trapped against the shield wall upon mating the connector and the counterconnector, which could result in plastic deformation of (the second portion of) the spring element. The spring element, and therewith the shielding arrangement, is therefore relative safe from damage.

Thus, in the shielding assembly according to the invention, the size, strength and/or resiliency of the spring element of the shielding assembly need not be dimensioned for withstanding plastic deformation. The spring element therefore may be formed for accepting relatively large amounts of elastic deformation and for having a relatively low spring constant.

The former aspect provides a relatively large tolerance for true positioning of the connector and the counterpart connector of the connector assembly with respect to each other. The latter aspect facilitates mating the connector and the counterpart connector by providing a relatively low insertion resistance, hence reducing the required insertion force.

It is generally desired that a plurality of adjacent spring elements are provided for reasons of increasing effective EMI shielding by reducing apertures in the shielding. For facilitating designing and manufacturing of the shielding assembly and thus of at least the connector of the connector assembly the plural spring elements are substantially identical.

The assembly of claim 2 allows a relatively large freedom of movement for the second section of the spring element, in particular if the contact portion and the portion of the first section are arranged on opposite sides of the shield wall. The second section is advantageously arranged such that its displacement upon mating is also unobstructed by the counterpart connector. Such a configuration also allows limiting the opening in the shield wall to the extent which is necessary for the passage and/or movement of the first section, for a better EMI shielding. A configuration with the second section also moving through the shield wall (for instance if the shielding member is attached inside the shielding assembly, falls in the scope of the invention even if not the most preferred.

In the assembly of claim 3 the displacement of at least the third portion of the spring element is limited. This may protect the spring element against excessive deformation. The third portion may make electrical contact with the shield member. This aspect is discussed in more detail below.

The assembly of claim 4 allows shortening the electrical path between the shielding arrangement of the connector and the counterpart connector, to the distance between the fulcrum and the contact point between the spring element and the counterpart connector. Such a feature also allows combining a relatively low spring force and/or large deformation range for the second portion of the spring element with a relatively large contact force for the contact portion against the counterpart connector by using a lever-effect between on the second portion of the spring element. An increased contact force reduces contact resistance of the electrical contact and may improve scraping off a dust-, debris- and/or oxide layer which may be present on the counterpart connector, thus improving the electrical contact.

Advantageously, the third portion is free from contact with the shield wall in the first position (unmated situation), whereas the third portion comes at least in mechanical contact with the shield wall during mating the connector and the counterpart connector, remaining in mechanical contact with the shield wall in the second position (mated situation). This provides a relatively low contact force for at least a first amount of displacement of the third portion, and thus a relatively low insertion force, during the initial stage of mating the connector assembly. During the later stage of mating and in the mated situation the lever-effect is employed.

In the assembly of claim 5, the spring element is configured for concentrating deformation of the spring element in the second portion, which is provided with space for such deformation. This assists preventing the spring element from being plastically deformed. This also allows optimising the different portions for their different functions within the spring element.

In the assembly of claim 6, the elastic deformation of the spring is in plural directions, such that deformation stresses are distributed instead of being localised. Thus, a spring element is provided which may have a large mechanical strength against deformation various directions, and which may have at the same time a relatively low spring constant.

Further, in this assembly, the desired maximum deformation of the spring element may be confined in a particular volume, rather than in a single direction. Thus, particular combinations of spring force, true positioning tolerance and available space in different directions for (the shielding assembly of) the connector may be met more easily.

Due to the spring element extending at least partially inside or trough the slot(s), the shield wall extends at least partially around the spring element in the assembly of claim 7. Thus one or more edges of the shield wall allow protecting the spring element against excessive deflection in a direction towards that edge/those edges. Further, apertures in the shield are reduced and thus EMI shielding efficiency of the assembly is improved.

One or more spring elements may be arranged at least partially within a slot.

The assembly of claim 8 allows reducing the height of (the shield wall of) the connector while still providing the benefits of having slots, which provide edges substantially in three directions.

The assembly of claim 9 allows substantially decoupling the spring function and the electrical connection function of the spring element. In case the spring element is insulating, e.g. being made of a plastic, the at least one conducting path may be the first electrical connection path.

The at least one electrical connection path may be an additional connection path. Providing the spring element with a plurality of connection paths may reduce the electrical resistance of the shielding assembly. This improves the shielding effect of the shielding assembly.

The path length of the shortest connection path is a decisive factor for the inductance of the shielding assembly. Generally, the shorter the path is, the lower will be the inductance.

The assembly of claim 10 thus provides a spring element which allows a relatively long spring—generally allowing a large deflection—, a relatively low resistance and a relatively shorter electrical connection path—generally allowing shielding a high frequency—.

The electrical connection path may be established by a conductive element, such as a wire, in-between the first portion and the shield member. A simpler solution is provided by an assembly in which the one or more spring elements of the shielding assembly are formed such that at least in the mated situation of the connector and the counterpart connector the second contact point of those spring elements provides a direct contact, both mechanical and electrical contact, with the shield wall, such as discussed above with respect to claims 3 and/or 4.

The assembly of claim 11 provides a substantially modular shield assembly, and therewith a substantially modular connector. This allows optimising properties such as material properties of at least the shield member and the spring member relatively independent from each other. E.g., the spring member may be manufactured from thin elastic sheet material such as phosphor bronze, whereas the shield member may be manufactured from a different, substantially more rigid material, e.g. a material suitable for deep drawing.

Another aspect of the invention is a shielding assembly according to claim 12.

Such a shielding assembly allows a relatively large amount of deformation of the spring elements upon mating, while still providing a relatively short electrical connection path. Thus, the shielding assembly combines a relatively large tolerance for true positioning of the connector and the counterpart connector with a relatively low inductance and therewith EMI-shielding for high frequencies.

Another aspect of the invention is a shielding assembly according to claim 13.

The shielding assembly provides a relatively large amount of deflection of the spring elements and a short electrical connection path for EMI shielding of the connection between the connector and the counterpart connector at relatively high frequencies. The spring element is protected against excessive deformation, which may lead to plastic deformation instead of elastic deformation. The connector assembly may be formed relatively low, saving valuable mounting volume.

A connector assembly may be provided as a whole or by providing the connector and the counterpart connector individually. Consequently, another aspect of the invention is the connector defined in claim 13.

The connector of the connector assembly may be manufactured substantially modular, hence another aspect of the invention is the shielding assembly defined in claim 14.

SUMMARY OF THE INVENTION

The invention will be explained in more detail hereafter with reference to the drawings, which serve for illustration purposes only.

DETAILED DESCRIPTION OF EMBODIMENTS

In the Figures, identical objects and elements are indicated with identical reference signs.

Figure 1:
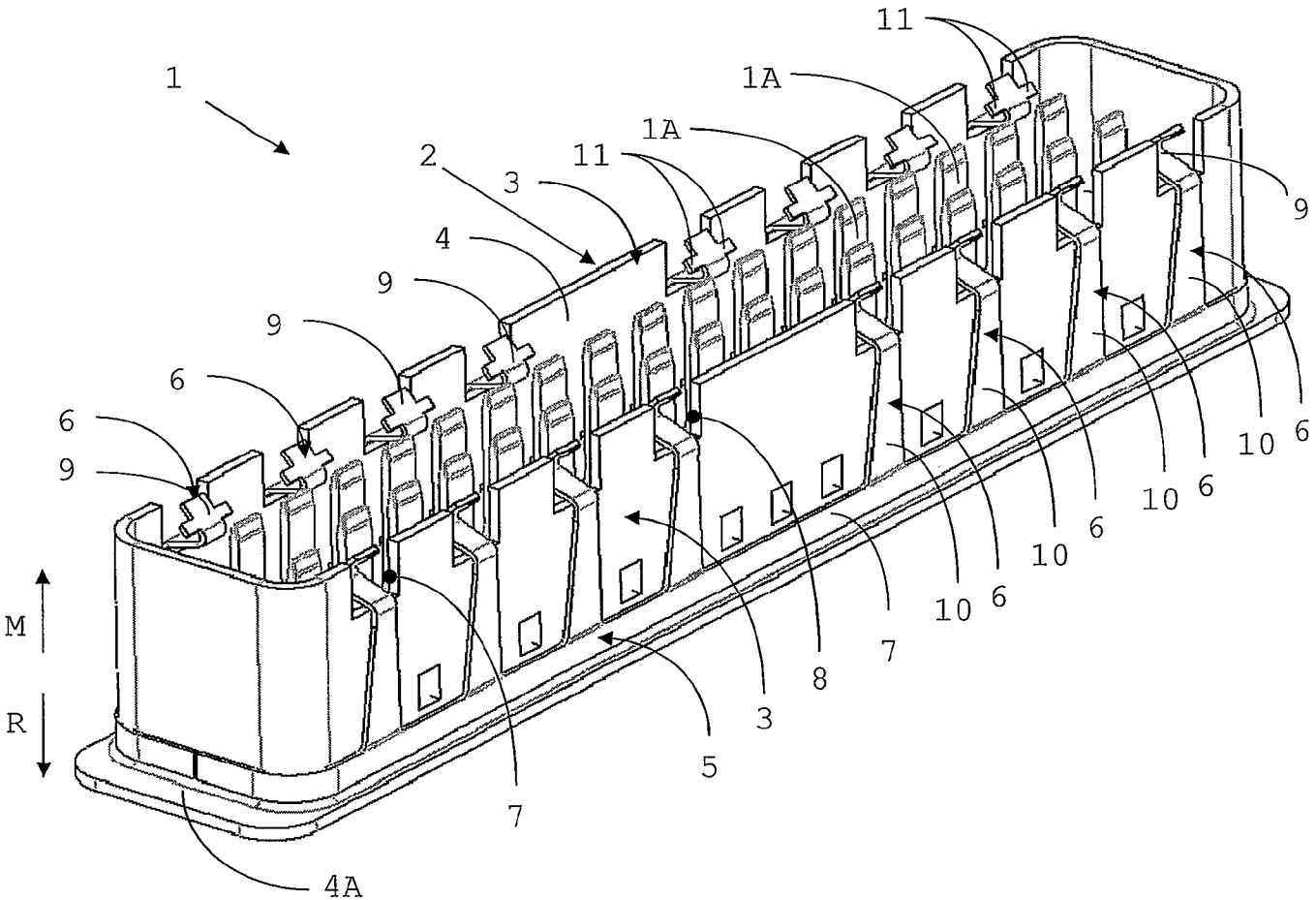
FIGS. 1 and 2 are perspective views of a first and a second embodiment of a connector comprising a shielding assembly of the invention.
Figure 2:
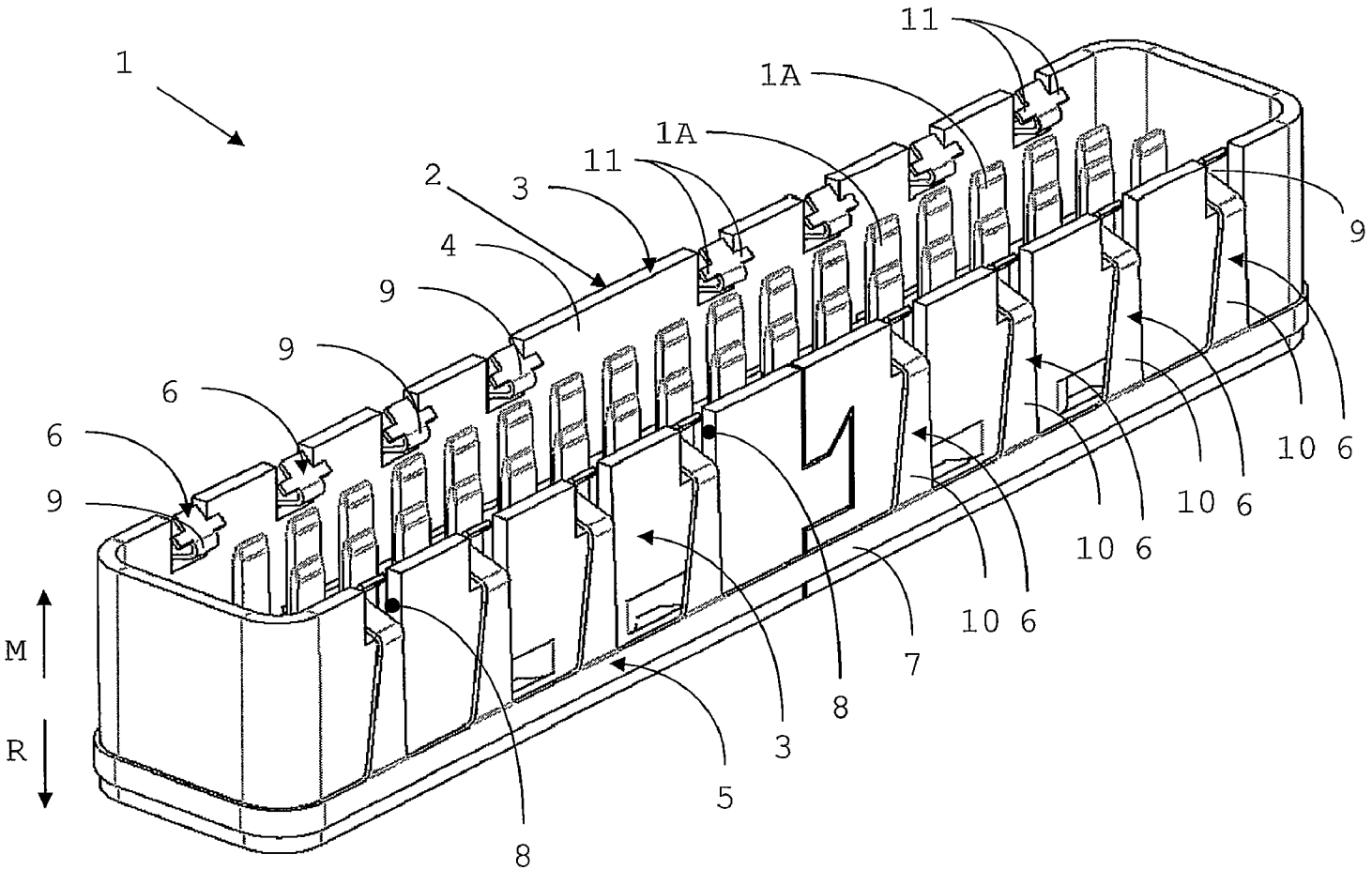

FIGS. 1 and 2 show two similar embodiments of a connector 1 of a connector assembly comprising the connector and a counterpart connector (not shown). The connector 1 comprises a plurality of contact terminals 1A and a shielding assembly 2. The connector 1 has a mating side towards a mating direction M and a rear side towards an opposite direction R, indicated with arrows in FIG. 1.

The shielding assembly 2 comprises a shield member 3 having a shield wall 4. The shielding assembly 2 further comprises a spring member 5 comprising a plurality of spring elements 6 which are joined by a carrier strip 7.

The shield member 3 of the embodiment of FIG. 1 is a unitary object comprising the shield wall 4 and a mounting flange 4A at the rear side. This shield member 3 is suitably manufactured by techniques such as deep drawing.

Figure 3B:
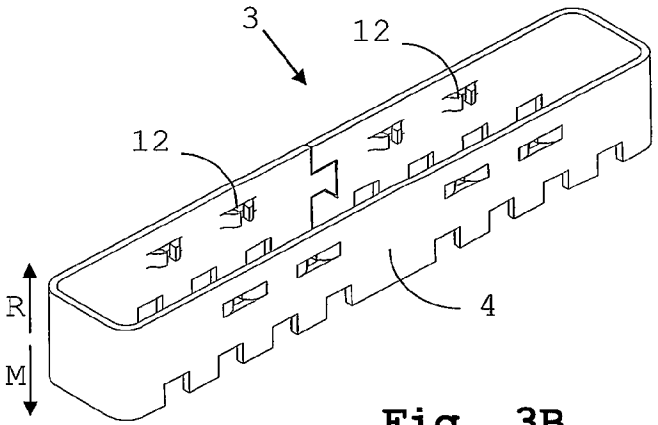
FIGS. 3A-3C are perspective views of a shield wall of the embodiment of FIG. 1 in folded and unfolded states, respectively.
Figure 3A:
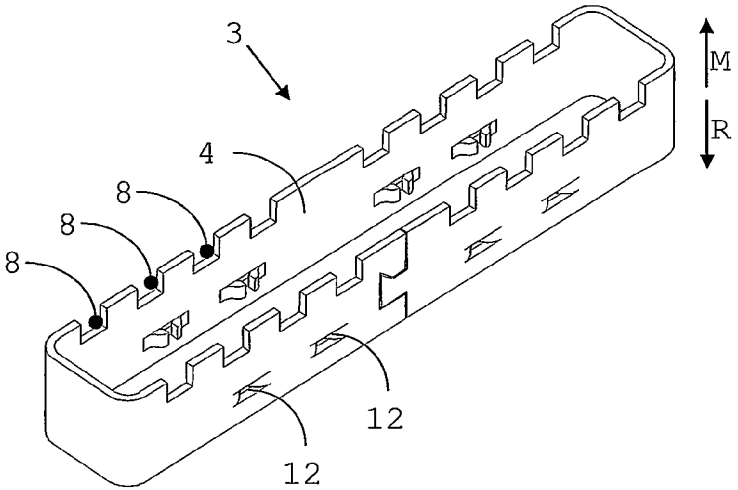

The shield member 3 of the embodiment of FIG. 2 is generally a bent strip without a mounting flange and it is shown in more detail in FIGS. 3A-3C, wherein FIG. 3A is a perspective view from above and FIG. 3B is a perspective view from below.

Figure 4A:
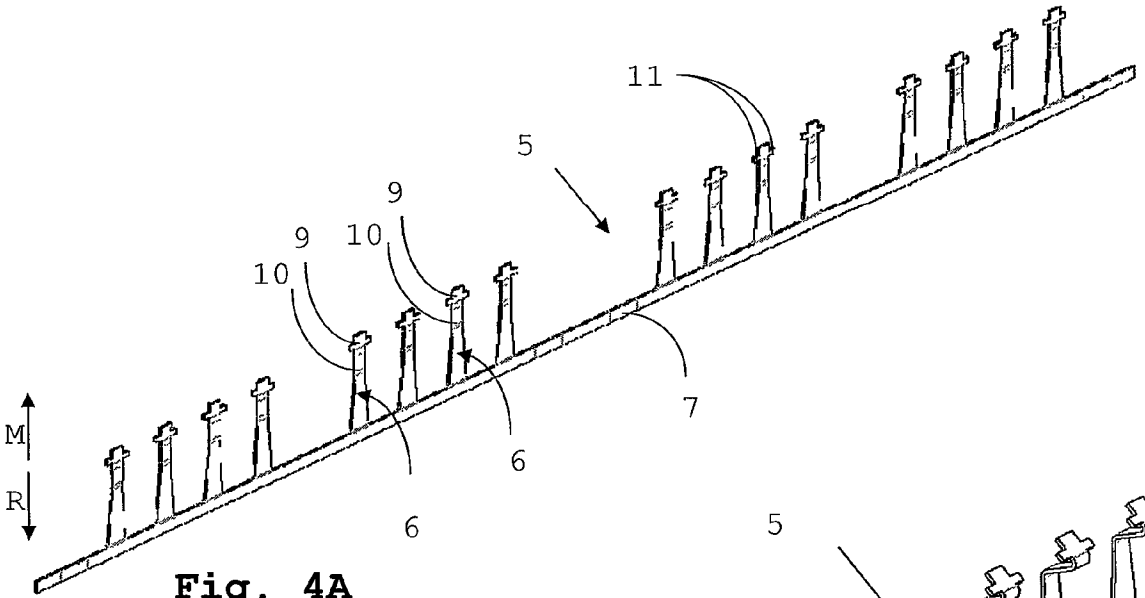
FIGS. 4A and 4B are perspective views of a spring member of the embodiment of FIG. 1 in folded and unfolded states, respectively.
Figure 4B:
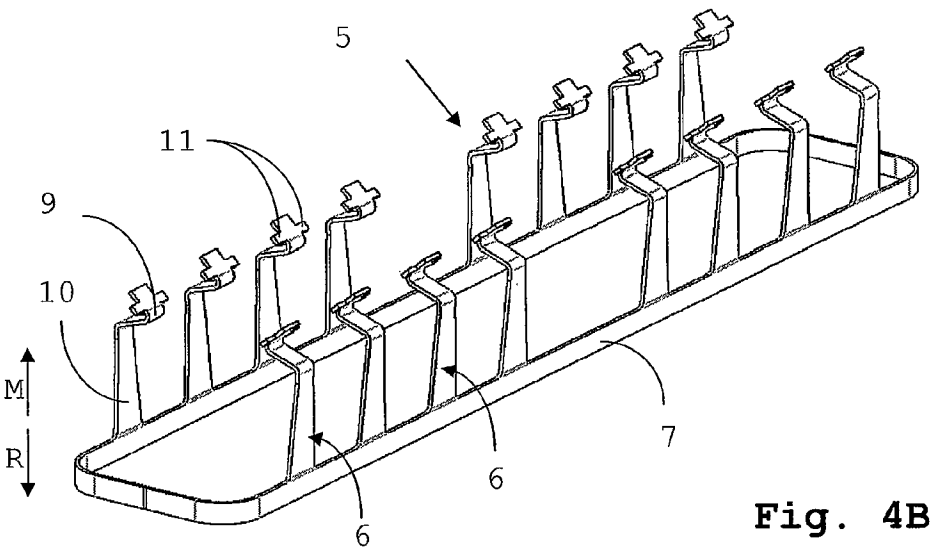

The spring member 5 of both embodiments of FIGS. 1 and 2 is substantially identical and it is shown in more detail in FIGS. 4A, 4B.

The shield wall 4 of the shield member 3 comprises a plurality of slots 8. The slots 8 are open at the mating side of the shield member 3, giving the shield wall 4 a substantially castellated shape with relatively high portions in between adjacent slots 8. The rear side of the shield wall 4 may comprise means for mounting to a further object, e.g. the flange 4A shown in FIG. 1.

The spring elements 6 of the spring member 5 are configured for making electrical contact between the shield wall 4 and the counterpart connector in the mated situation of the connector and the counterpart connector. Each spring element 6 comprises a first portion or contact portion 9 configured for making electrical contact with the counterpart connector. Each spring element 6 further comprises second portion or spring portion 10 for providing a spring force to the contact portion 9. In the embodiments shown each spring element 6 is provided with tongues or protrusions 11 extending on either side from the spring element 6 near the contact portion 9.

As shown in FIGS. 1 and 2, the spring elements 6 are arranged partially through the castellation slots 8 such that the contact portions 9 of the spring elements 6 are arranged on the inside of the shield wall 4, i.e. at the side of the contact terminals 1A, whereas the spring portions 10 are arranged at the outside of the shield wall 4. However it should be noted according to another embodiment (not shown), the contact portions 9 of the spring elements 6 are located on the outside of the shield wall 4, while the spring portions 10 are arranged at the inside of the shield wall 4.

The protrusions 11 extend substantially parallel to the shield wall 4 and perpendicular to the mating direction M. As shown in FIGS. 1 and 2, the width of the spring elements 6 at the position of the protrusions 11 is larger than that of the slot 8 through which the spring element 6 penetrates. This secures the spring element 6 within the slot 8 and limits movement in directions perpendicular to the shield wall 4, towards the shield outside. The movement of a contact portion 9 in parallel to the shield wall 4 is limited by the width of the slot 8.

For providing a suitable EMI shielding function the shield member 3 should comprise an electrically conducting material. Suitable materials comprise e.g. metals and conducting plastic materials. Similarly, the spring element 6 should comprise a conductive material at least for the contact portion 9. Preferably the entire spring member 5 is conductive. For instance it is a metal piece. The shield member 3 and the spring member 5 are preferably electrically interconnected and they may be mechanically attached together as shown in FIGS. 1 and 2, e.g. by welding, soldering, gluing etc. or by mechanical means such as clamping, riveting, etc. The respective material of the shield member 3 and the spring member 5 may be chosen for optimizing their respective properties.

The spring member 5 may also comprise means for mounting the spring member 5 to a further object, such as a printed circuit board. E.g., the carrier strip 7 of the spring member 5 may comprise one or more mounting tails adapted to be connected to a receiving portion of a printed circuit board. The mounting tails extend from the carrier strip 7 in opposite direction to the spring element 6.

Figure 5:
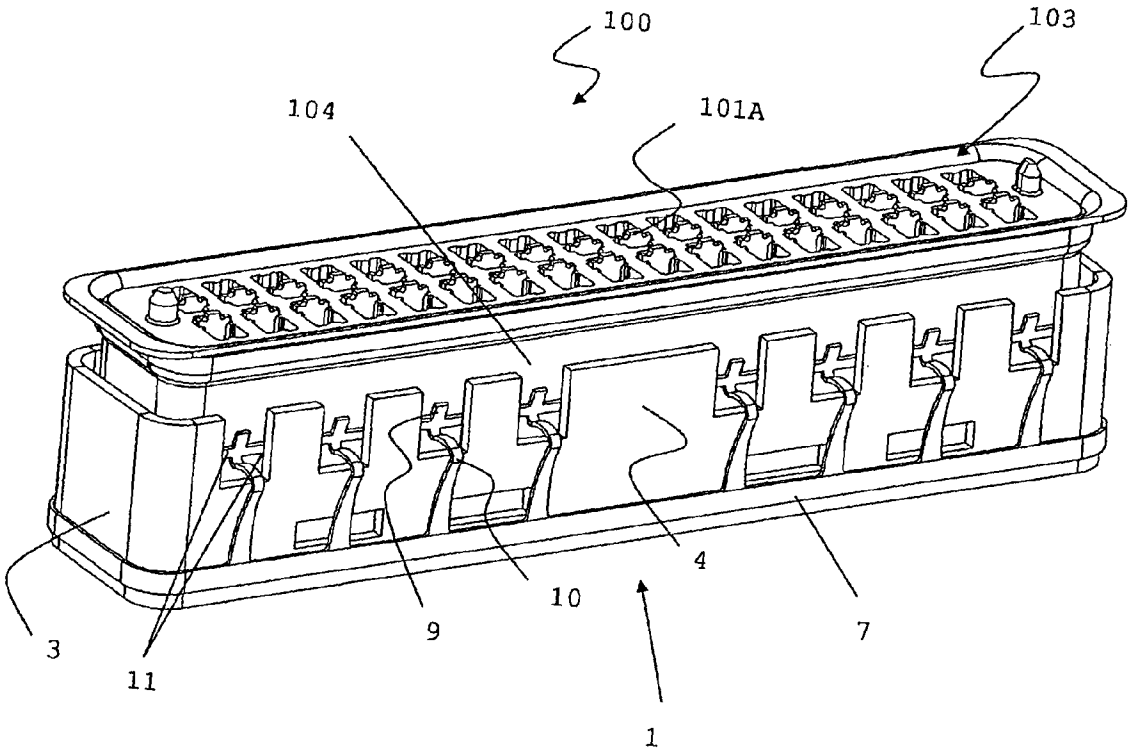
FIG. 5 is a perspective view of a connector assembly in a mated situation.

FIG. 5 shows the connector 1 of FIG. 1 and a counterpart connector 100 in a mated situation. The counterpart connector 100 comprises a plurality of contacts 101A and a shield member 103 with a shield wall 104.

Figure 6C:
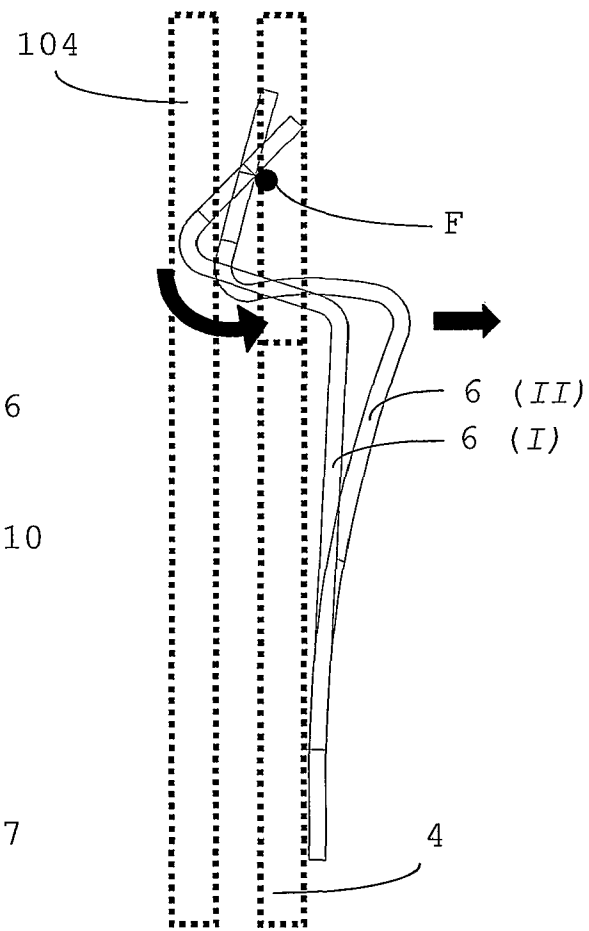
FIGS. 6A-6C indicate the operation of a first embodiment of a spring element.
Figure 6B:
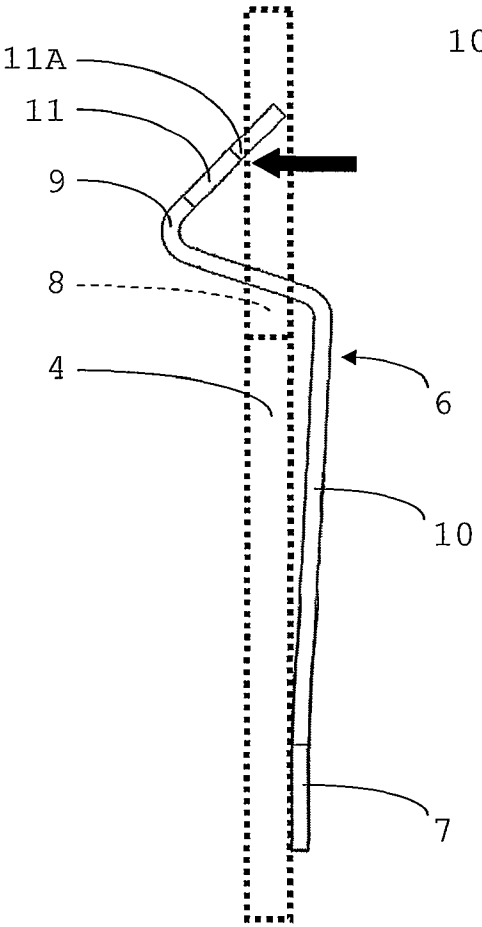
Figure 6A:
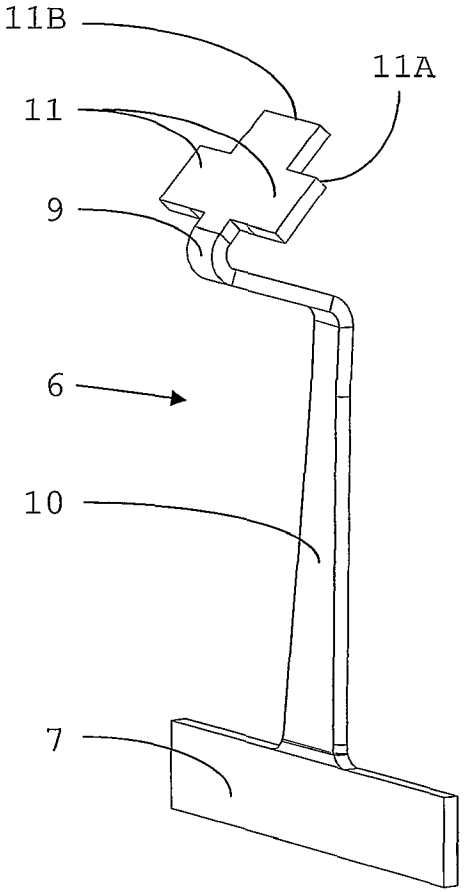

FIGS. 6A and 6B show a spring element 6 of the embodiments of FIGS. 1-5. FIG. 6A is a perspective view, FIG. 6B is a side view. In FIG. 6B the shield wall 4 of the shield member 3 is also indicated. FIG. 6C is a view similar to FIG. 6B, including the shield walls 4 and 104 of both the connector 1 and the counterpart connector 100 respectively. FIG. 6C shows the different positions of the spring element 6 in the unmated situation (indicated with I; see also FIG. 6B) and in the mated situation (II).

In the unmated situation of the connector 1 and the counterpart connector 100, the spring elements 6 are arranged substantially as depicted in FIGS. 1 and 2, with the contact portions 9 positioned at a certain distance from the shield wall 4 and the spring portions 10 positioned close to the shield wall 4, or possibly in contact with it. An edge 11A of the protrusions 11 may be in contact with the shield wall 4 aside the slots 8, as indicated with the black arrow in FIG. 6B, but they may also be free from contact with the shield wall 4 in the unmated situation.

Upon mating the connector and the counterpart connector, see FIGS. 5 and 6C (situation II), the contact portions 9 engage the side of the counterpart connector 100 and will be pressed outward, towards the shield wall 4. At the same time, the spring portions 10 are also pressed outwards, away from the shield wall 4 to become (further) separated from the shield wall 4. The displacement of the spring portion 10 is substantially unobstructed by the shield wall 4.

The deflection of the spring element 6 brings the edges 11A of the protrusions 11 into contact with the shield wall 4. This provides a fulcrum F for a rotation of the spring element 6 with respect to the shield wall 4, as indicated by the black dot and the black arrows in FIG. 6C. The relatively short length of the portion of the spring element 6 between the contact portion 9 and the edge 11A compared to the spring portion 10 provides a lever action. This allows reducing the spring constant of the spring portion 10 while maintaining a contact pressure of the contact portion 9 onto the shield wall 104 of the counterpart connector 100 sufficient for removing dirt and/or breaking an oxide barrier on the shield wall 104 (self-cleaning effect).

The contact between (the edges 11A of) the protrusions 11 and the shield wall 4 establishes an electrical contact between the shield member 3 and the spring element 6 in case both are conducting. Thus an electrical connection path between the contact portion 9 and the shield member 3 is established via the protrusions 11 which is relatively short and thus advantageously results in a relatively low inductance of the path.

In the shown embodiments the electrical contact between the contact portion 9 and the shield member 3 via the protrusions 11 is a second electrical connection path in addition to a first connection path between the contact portion and the shield member 3 via the spring portion 10 and the carrier strip 7 of the spring member 6. It will be appreciated that the second electrical connection path via the protrusions 11 is significantly shorter than the first one via the spring portion 10. Thus, the inductance and resistance of the electrical connection between the contact portion 9 and the shield member 3 are reduced, improving the shielding characteristics of the shielding assembly.

In case the slots 8 are not open on the mating side, i.e. the slots 8 are holes through the shield wall 4, the tip 11B of the spring member 6 may act in the same manner as set out for the edges 11A.

Figure 3C:
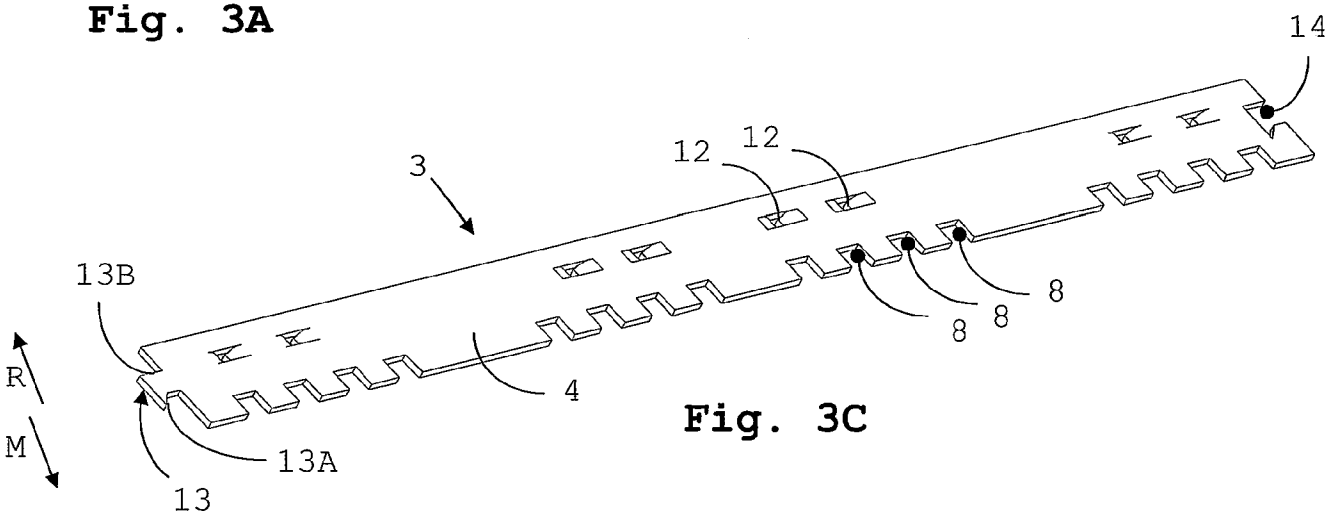

Referring now in more detail to FIGS. 3A-3C, the shield member 3 of the embodiment of FIG. 2 is manufactured of a single strip forming the shield wall (FIG. 3C), which may be cut or stamped from a sheet material such as a sheet of metal. The strip is bent to the desired shape (FIGS. 3A, 3B). The shield member 3 comprises means, here in the form of clamps 12, for attaching one or more other parts of a connector, e.g. insulation portions.

The longitudinal ends of the strip are provided with a locking tab 13 and a matching recess 14, respectively, forming closing features 13, 14 for maintaining the bent shape of the shield member 3. The locking tab 13 is asymmetric, having a pointed side 13A directed towards the future mating direction M of the shield member 3 and a substantially straight side 13B which is substantially parallel to the (future) rear side of the shield member 3. The recess 14 is shaped accordingly. The asymmetric closure means 13, 14 assist maintaining the rear side of the shield member 3 substantially planar.

A substantially planar rear side is particularly important in case the shielding assembly 1 is mounted on a board connector, since in that case the shield member 3 may be fixed to the board substantially only by soldering it. A non-coplanar shielding member may cause one or more weak spots in the soldering contact which may lead to EMI leakage. When mechanical stress concentrates at such a weak spot it may also lead to a partial or complete failure or breaking off of the assembly. To provide mechanical stability and to ensure and maintain a substantially planar rear side, the shield member 3 may be made with a relatively thick and robust material.

Similarly, the rear side of the flange 4A of the shield member 3 of FIG. 1 may be made planar to a high degree. Further, manufacturing by deep-drawing generally provides very stiff and strong objects which tend to exhibit very little deformation, even for relatively thin-walled objects.

The spring member 5 may also be manufactured by cutting or stamping from a sheet material (FIG. 4A) with subsequent bending (FIG. 4B). A fully-formed spring member 5 may be mounted to a fully-formed shield member 3. However, for the embodiment of FIG. 2 the following method has proven advantageous on grounds of -inter alia- process economy and reproducibility: manufacturing the shield member to the stage shown in FIG. 3C in one or more steps, manufacturing the spring member 5 including bending of the spring elements 6 but not including bending the carrier strip 7, attaching the shield member 3 and the spring member 5 together, e.g. by soldering, welding, clamping or riveting, and then forming, e.g. bending, the attached members 3, 5 to the desired shape of the shield member 1.

FIGS. 7A-9B are various views of different embodiments of spring elements 6.

Figure 7C:
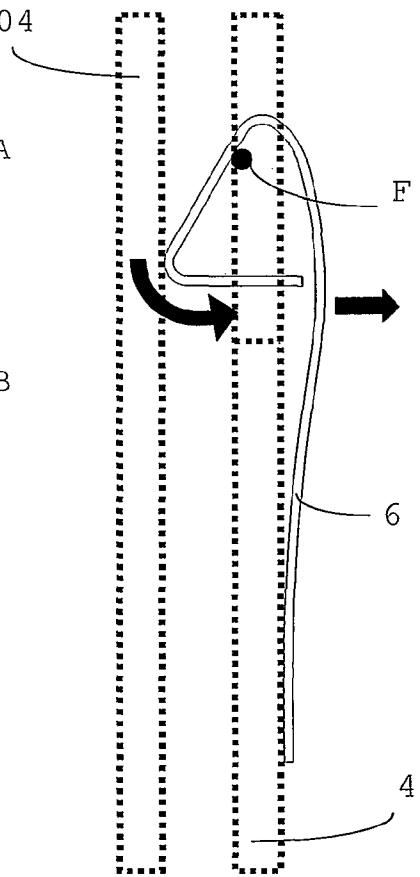
FIGS. 7A-7C indicate the operation of a second embodiment of a spring element.
Figure 7B:
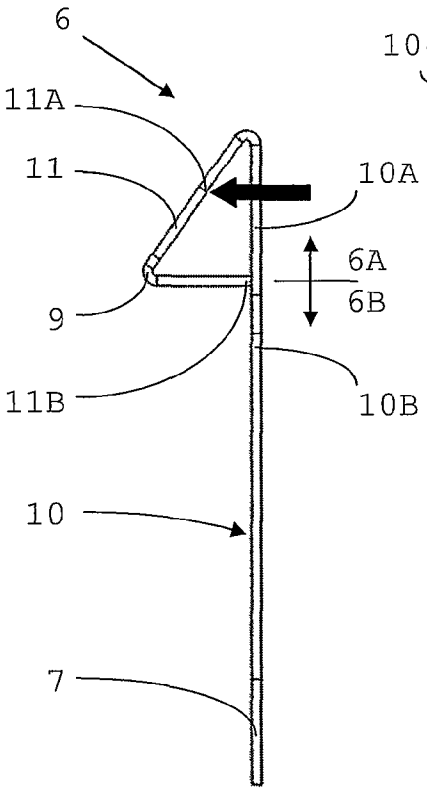

Like FIGS. 6A-6C, FIG. 7A is a perspective view of a spring element 6 and FIG. 7B is a side view in the unmated situation. FIG. 7C illustrates the spring element 6 and the shield walls 4 and 104 in the mated situation, respectively.

Figure 7A:
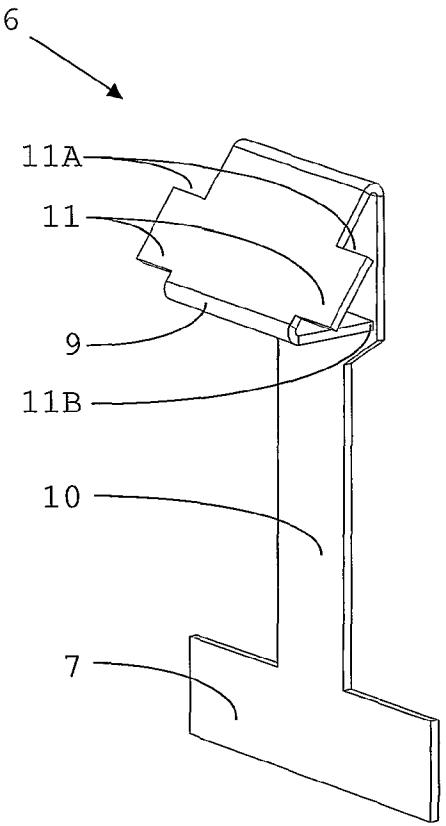

Whereas the embodiment of FIGS. 6A-6C is substantially s-shaped, the embodiment of FIGS. 7A-7C is bent over to provide a substantially q-shaped spring element 6 comprising a loop portion 6A and a tail portion 6B as indicated in FIG. 7B. Correspondingly, the spring portion 10 may be seen to comprise two portions 10A and 10B. The loop portion 6A has a tip 11B which preferably is not in contact with the spring portion 10 such that the loop portion 6A is not fully closed.

Upon mating the connector 1 and the counterpart connector 100, the spring element 6 will deflect outward. If the edges 11A of the protrusions 11 come into contact the shield wall 4, a fulcrum F is formed and the spring element 6 will deform as indicated in FIG. 7C.

Should the tip 11B come into contact with the spring portion 10, the effective spring action is divided asymmetrically over the portions 10A and 10B. Thus, the spring constant of the spring element 6 is significantly increased, increasing the contact pressure and decreasing the contact resistance of the contact portion 9 to the counterpart connector 100.

Figure 8C:
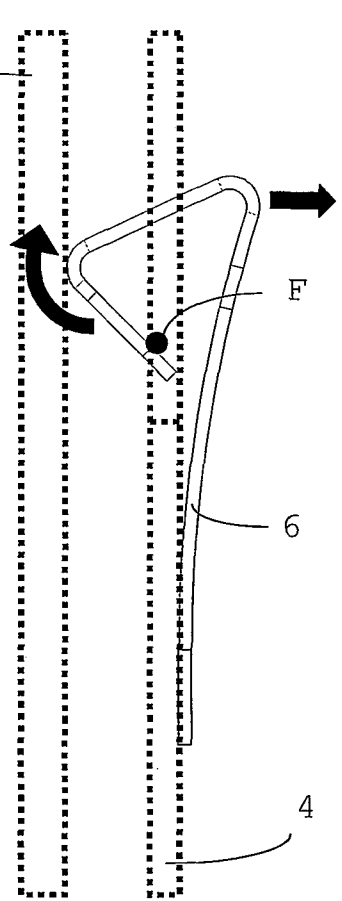
FIGS. 8A-8C indicate the operation of a third embodiment of a spring element.
Figure 8B:
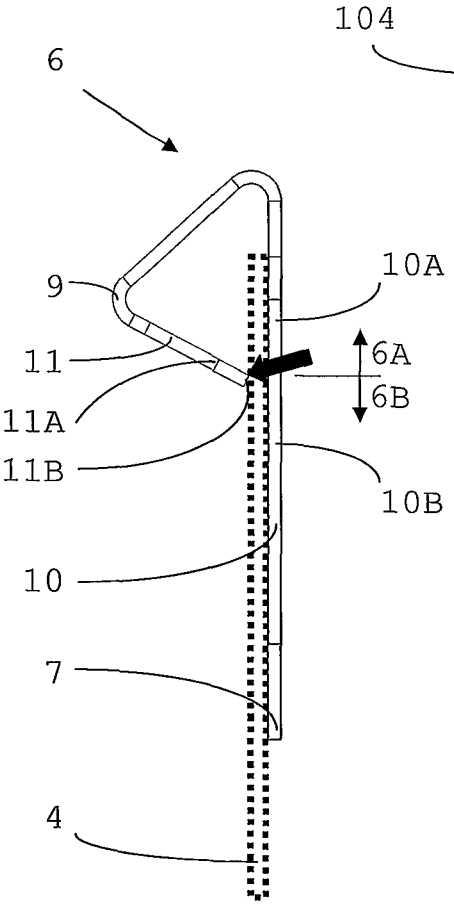
Figure 8A:
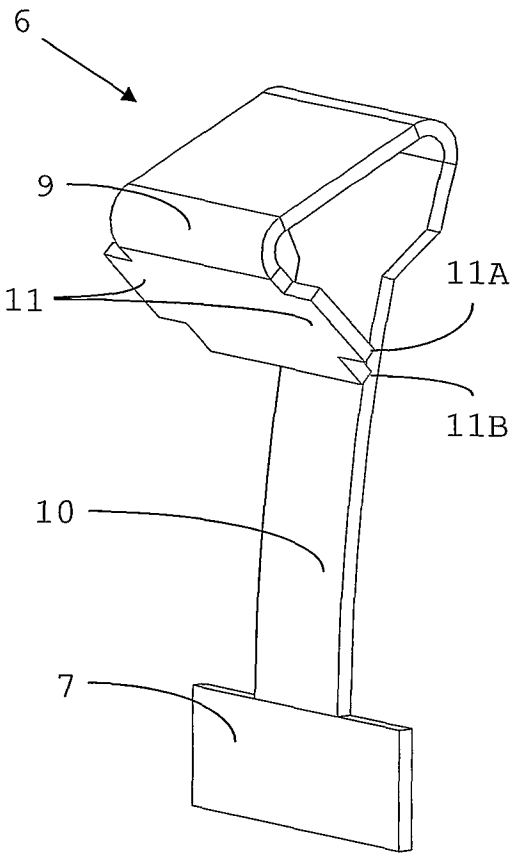

FIGS. 8A-8C are similar views to FIGS. 7A-7C of another embodiment of a spring member 6. Compared to the embodiment of FIGS. 7A-7C, in the embodiment of FIGS. 8A-8C the protrusions 11 are arranged in-between the contact portion 9 and the tip 11B, hence the fulcrum F provided by the edges 11A touching the shield wall 4 is at another side of the contact portion 9 relative to FIGS. 7A-7C. As may be seen from the arrows in FIG. 8C, in the mated situation this provides an opposite rotation of the contact portion 9 with respect to the carrier portion 7 compared to FIG. 7C. This may reduce the friction during mating of the connector 1 and the counterpart connector 100 in an arrangement wherein the spring member 5 is arranged inverted to FIGS. 1 and 2, i.e. the carrier 7 is arranged towards the mating direction M and the contact portion 9 is arranged towards the rear side R.

As indicated with the bold black arrow in FIG. 8B, the tip 11B of the spring portion may serve for providing the fulcrum for rotation rather than the edges 11A of the protrusion. This may obviate slots 8 in a shield wall 4.

In order to reduce the spring force of the spring portion 10 and/or to localize regions of the spring element 6 in which deformation should be confined, the spring portion 10 may be suitably made longer and/or made thinner in one or more dimensions relative to the contact portion 9 and/or adjacent portions. E.g., in FIGS. 7A-8C, the spring portion 10A in the loop portion 6A is significantly wider than the spring portion 10B in the stem portion 6B.

Figure 9B:
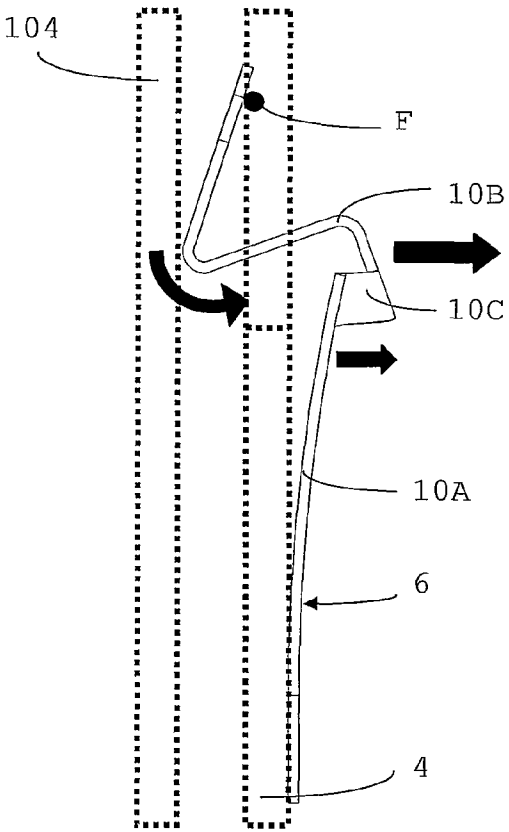
FIGS. 9A-9B indicate the operation of a fourth embodiment of a spring element.
Figure 9A:
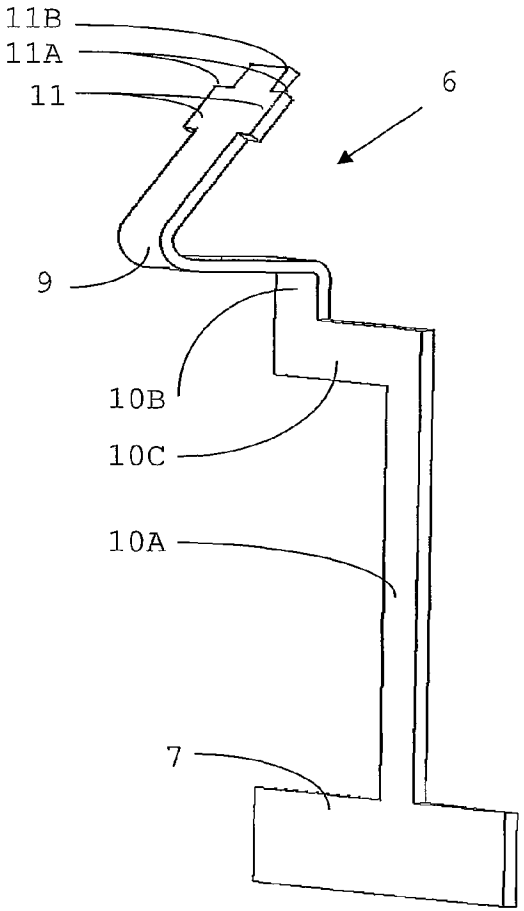

Another option is the embodiment of FIGS. 9A, 9B, which is generally similar to the embodiment of FIGS. 1-6C. In the embodiment of FIGS. 9A-9B the spring portion 10 comprises three adjacent portions 10A-10C, wherein the middle portion 10C extends at an angle of about 90 degrees to the other portions 10A, 10B, giving the spring element 6 a generally Z-like shape in two substantially perpendicular directions and allows the spring element 6 to resiliently deform also in a direction substantially perpendicular to the direction of deformation of the embodiment of FIGS. 1-6C. The combined deformation provides a torsion spring force to the spring element in the mated situation. This can be appreciated from FIG. 9B which shows that different sides of portion 10C have been displaced different amounts away from the shield wall 4. The result of the additional portion is a weaker spring constant and a distribution of the deformation over a larger amount of material, even with the same length of the spring element 6 in the mating direction as in the embodiment of FIGS. 1-6C.

Thus, by interchanging the spring member 5 of the embodiment of FIGS. 1-6C by a spring member 5 with spring elements 6 of the embodiment of FIGS. 9A-9B a reduced spring force may be employed with the same shield member 3.

A spring member comprising spring elements according to FIGS. 9A-9B may also be stamped and bent as for all other embodiments. The portion 10C may be arranged at a different angle than about 90 degrees, e.g. about 30, 45 or 60 degrees to the direction of extension of the portions 10A, 10B, e.g. for allowing a relatively close packing of contact springs 6 if the perpendicular portion 10C as in FIGS. 9A-9B is considered to render the spring element 6 too wide.

Alternatively, the spring portion 10 may comprise further portions extending in different directions, e.g. with several zigzagging portions. This further increases the mechanical length, allowing further reducing spring force and distributing deformation both in deflection and torsion. Electrical contact between the protrusions 11 or the tip 11B of the spring element 6 and the shield wall 4 still provides a low inductance to the shielding arrangement.

The invention is not restricted to the above described embodiments which can be varied in a number of ways within the scope of the claims. For instance, the spring elements may be provided separately, instead of joined on a carrier strip.

The shape of the shield member may be different.

One or more contact portions may be provided with bumps, ridges etc. for increasing local contact pressure and thus reducing electrical contact resistance.

The invention claimed is:

1. A shielding assembly for a connector assembly comprising a connector and a counterpart connector, the shielding assembly comprising a shield member having a shield wall and at least one spring element for making electrical contact between the shield wall and the counterpart connector along a first electrical conduction path in the mated situation of the connector and the counterpart connector;

wherein the spring element comprises a first portion being configured for making electrical contact with the counterpart connector, in the mated situation, and a second portion for providing a spring force to the first portion, wherein the spring element is configured for having at least a first position in the unmated situation of the connector and the counterpart connector and a second position in the mated situation of the connector and the counterpart connector, such that in the first position the second portion is arranged at a first separation from the shield wall and in the second position the second portion is arranged at a second separation from the shield wall, wherein the second separation is larger than the first separation.

2. A shielding assembly according to claim 1, wherein the at least one spring element of the shielding assembly is arranged with at least the first portion at one side of the shield wall and at least a portion of the second portion at another side of the shield wall.

3. A shielding assembly according to claim 1, wherein the at least one spring element of the shielding assembly comprises a third portion (HA; HB) for making at least mechanical contact with the shield wall in at least the second position of the spring element.

4. A shielding assembly according to claim 1, wherein at least in the second position the third portion (HA; HB) provides a fulcrum for a rotation of at least a portion of the spring element located between the first portion and the fulcrum.

5. A shielding assembly according to claim 1, wherein the second portion of the spring element has a flexibility which is higher than that of another portion of the spring element.

6. A shielding assembly according to claim 1, wherein the second portion of the at least one spring element is configured for providing a spring force to the first portion by allowing resilient deformation in at least two substantially perpendicular directions and/or a combination of resilient deflection and torsion.

7. A shielding assembly according to claims claim 1, wherein the shielding assembly comprises the shield member and a spring member, the spring member comprising a plurality of spring elements.

8. Connector assembly comprising a connector and a shielding assembly according to claim 1.

9. A shielding assembly according to claim 1, wherein the shield wall of the shield member comprises at least one slot, and wherein the at least one spring element is arranged at least partially in or through the slot.

10. A shielding assembly according to claim 9, wherein at least a portion of the shield wall of the shield member has a substantially castellated shape.

11. A shielding assembly according to claim 1, wherein the at least one spring element comprises at least one portion configured for providing at least in the second position of the spring element at least one electrical connection path between the first portion of the spring element and the shield member which is different from a path along the second portion.

12. A shielding assembly according to claim 11, wherein the at least one spring element provides at least a first electrical connection path between the first portion of the spring element and the shield member and a second electrical connection path between the first portion of the spring element and the shield member wherein the first electrical connection path is arranged along the second portion of the spring element and wherein the second electrical connection path is shorter than the first electrical connection path.

13. A shielding assembly for a connector assembly comprising a connector and a counterpart connector, the shielding assembly comprising a shield member having a shield wall and at least one spring element for making electrical contact between the shield wall and the counterpart connector along a first electrical conduction path in the mated situation of the connector and the counterpart connector;

wherein the spring element comprises a first portion being configured for making electrical contact with the counterpart connector, in the mated situation, and a second portion for providing a spring force to the first portion, wherein the spring element is configured for having at least a first position in the unmated situation of the connector and the counterpart connector and a second position in the mated situation of the connector and the counterpart connector, such that in the first position the second portion is arranged at a first separation from the shield wall and in the second position the second portion is arranged at a second separation from the shield wall, wherein the second separation is larger than the first separation, wherein the spring element comprises a third portion (HA; HB) for making contact with the shield wall in at least the second position of the spring element and providing at least one electrical connection path between the first portion of the spring element and the shield member which is shorter than a path along the second portion.

14. A shielding assembly for a connector assembly comprising a connector and a counterpart connector, the shielding assembly comprising a shield member having a shield wall and at least one spring element for making electrical contact between the shield wall and the counterpart connector along a first electrical conduction path in the mated situation of the connector and the counterpart connector;

wherein the spring element comprises a first portion being configured for making electrical contact with the counterpart connector, in the mated situation, and a second portion for providing a spring force to the first portion;

wherein at least a portion of the shield wall of the shield member of the shielding assembly has a substantially castellated shape and wherein the at least one spring element of the shielding assembly is arranged at least partially in or through a castellation slot with at least the first portion at one side of the shield wall and at least a portion of the second portion at another side of the shield wall;

wherein the spring element is configured for having at least a first position in the unmated situation of the connector and the counterpart connector and a second position in the mated situation of the connector and the counterpart connector, such that in the first position the second portion is arranged at a first separation from the shield wall and in the second position the second portion is arranged at a second separation from the shield wall, wherein the second separation is larger than the first separation;

wherein the spring element comprises a third portion (HA; HB) for making contact with the shield wall in at least the second position of the spring element and providing at least one electrical connection path between the first portion of the spring element and the shield member which is shorter than a path along the second portion.

* * * * *